US005452498A

United States Patent [19]

Veach

[11] Patent Number: 5,452,498

[45] Date of Patent: Sep. 26, 1995

[54] STIRRUP BUCKLE

[76] Inventor: Ben G. Veach, 815 South East St., Olney, Ill. 62450

[21] Appl. No.: 126,871

[22] Filed: Sep. 27, 1993

[51] Int. Cl.[6] ..... A44B 11/00; B68B 5/00

[52] U.S. Cl. ..... 24/176; 24/164; 24/181

[58] Field of Search ..... 24/180, 181, 171, 24/172, 173, 174, 176, 186, 164, 194, 198

[56] References Cited

U.S. PATENT DOCUMENTS

| | | | |
|---|---|---|---|
| D. 27,169 | 6/1897 | Mealey | 24/176 |
| 72,266 | 12/1867 | Clock | 24/176 |
| 374,177 | 12/1887 | Detrick | 24/186 |
| 509,937 | 12/1893 | Odom | 24/176 |
| 740,951 | 10/1903 | Uhlrig | 24/176 |
| 808,297 | 12/1905 | Miller | 24/181 |
| 1,055,045 | 3/1913 | Hunter | 24/176 |
| 1,365,551 | 1/1921 | Settles | 24/176 |
| 3,314,121 | 4/1967 | Blevins et al. | 24/181 |
| 3,570,077 | 3/1971 | Hawie | 24/164 |

*Primary Examiner*—Victor N. Sakran
*Attorney, Agent, or Firm*—Middleton & Reutlinger; David W. Carrithers

[57] ABSTRACT

A buckle for releasably connecting a stirrup strap to the saddle strap of a saddle. The buckle is an integral one-piece member having an outer frame which defines an opening. A mounting plate securely attaches the buckle to the stirrup strap. One or a pair of posts are formed on spaced opposite members of the frame for insertion through selected spaced holes of the saddle strap. The posts which are located on the frame member that is adjacent the mounting plate, extend generally perpendicularly outwardly from the frame. The other posts extends outwardly from the opposite frame member in an opposite direction than that of the other posts, and are curved downwardly toward the frame opening, and are also inserted through other spaced holes in the saddle strap to secure the two straps together.

16 Claims, 4 Drawing Sheets

STIRRUP BUCKLE

BACKGROUND OF THE INVENTION

1. Technical Field

The invention relates to stirrup buckles and in particular to a buckle which will facilitate and expedite the changing of the stirrup length, and which will provide a safe and secure connection between the stirrup strap and saddle strap.

2. Background Information

One of the elements of a riding saddle used for horses whether it be an English saddle, Australian saddle, Western saddle or other type, is the use of straps for adjustably suspending the stirrups which extend downwardly from the side of the saddle. Each of the stirrups is usually suspended in the looped end of a stirrup strap, which in turn is adjustably connected to a saddle strap, which strap is either rigidly or loosely connected to the saddle and extends downwardly therefrom.

Some type of buckle or fastening means is provided between the saddle strap and stirrup strap to enable an adjustment to be made to the length of the stirrup strap to enable the stirrup to accommodate various size riders. It is desirable that the strap connection or buckle provide an easy means for rapidly changing the stirrup length, while ensuring a rigid and secure connection between the saddle strap and stirrup strap to prevent premature separation of the connection therebetween, which could result in injury to the rider.

The most common type of stirrup buckle used for many Western type saddles is referred to as a "Blevins" buckle, and is shown in U.S. Pat. No. 3,314,121. Although this type of buckle has proven satisfactory over the years, it has one possible shortcoming, that is, as the buckle and straps age and after repeated use, the sliding connection between the sleeve and elongated tongue may become loose and not fit as securely thereon as desirable. This can result in the buckle becoming separated enabling the strap connecting posts to work free of their engagement in the holes of the saddle strap and become disconnected.

Therefore, the need exists for a stirrup buckle which ensures a secure connection between the saddle strap and stirrup strap in an easy and effective manner.

SUMMARY OF THE INVENTION

Objectives of the invention include providing an improved stirrup buckle which permits the easy adjustment between the stirrup strap and saddle strap to permit the length of the stirrup to be easily adjusted, yet which rigidly secures the two straps together preventing their premature separation even after extended periods of use of the buckle.

A still further objective of the invention is to provide a stirrup buckle which is formed relatively inexpensively of a single one-piece member, preferably stainless steel, which is rigidly and permanently secured to the stirrup strap and is adapted to be easily and securely releasably attached to the saddle strap to permit easy adjustment of the stirrup lengths.

Still another objective of the invention is to provide such a stirrup buckle in which side frame members of the buckle are angled to enable the stirrup strap and saddle strap to lie in general alignment with each other thereby decreasing the bulkiness and unevenness when the straps are connected, thereby reducing the formation of projections which are uncomfortable to the horse and/or rider.

A further objective of the invention is to provide such a stirrup buckle which requires movement of the buckle in several different directions in order to disengage the connected straps, which directions of motion would not occur during riding of the horse, thereby further preventing any accidental and premature separation of the connected buckle during riding which could possibly result in injury to the rider.

Another objective of the invention is to provide such a stirrup buckle which is sturdy and durable in construction, reliable and efficient in operation, relatively simple and inexpensive to manufacture and install on the stirrup strap, and which is easy to manipulate in a relatively expeditious manner to facilitate the changing of stirrup lengths.

These objectives and advantages are obtained by the improved stirrup buckle of the present invention, the general nature of which is a buckle utilized for releasably connecting a stirrup strap with a saddle strap, which buckle includes a mounting plate for securely attaching the buckle to an end of one of the stirrup and saddle straps, the other of said straps being formed with a series of spaced holes; a rigid frame attached to the mounting plate, said frame defining the periphery of an opening; first post means formed on and extending outwardly in a first direction from the frame for insertion through a selected hole of said other strap; and second post means formed on the frame at a location generally opposite of the first post means and extending outwardly in a second direction generally opposite of said first direction for insertion through another hole of said other strap.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
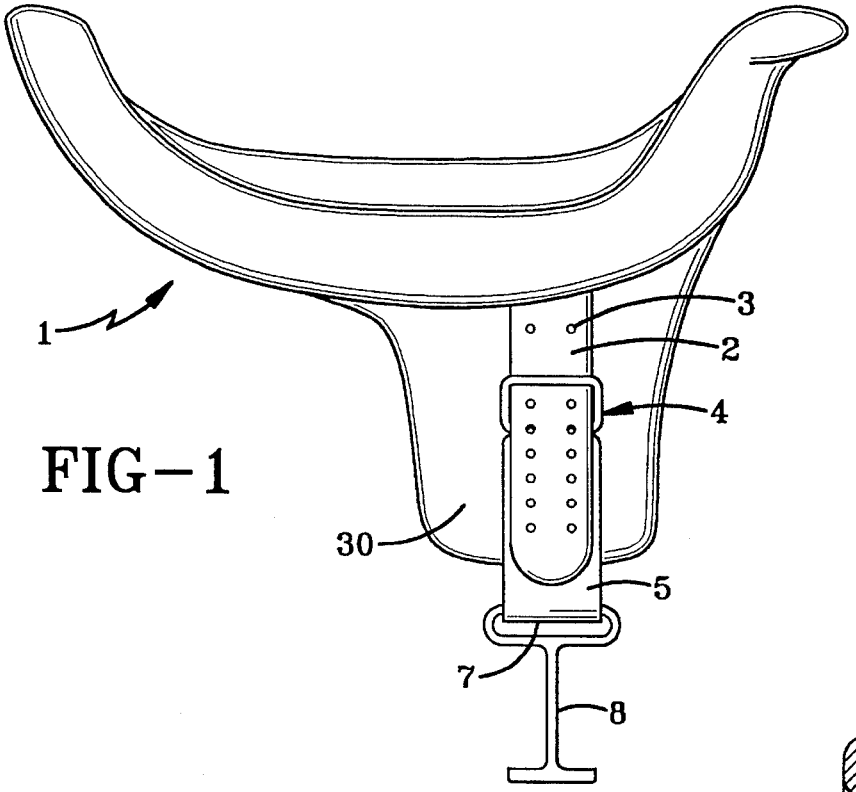
FIG. 1 is a diagrammatic side elevational view of a saddle showing a stirrup suspended in a stirrup strap which is connected to the saddle strap by the buckle of the present invention.

FIG. 1 depicts a usual saddle indicated generally at 1, which could have various conventional constructions. Saddle 1 includes a depending saddle strap 2 formed with a plurality of spaced holes 3 therein, which is connected by the improved buckle of the invention, which is indicated generally at 4, to a stirrup strap 5. Saddle strap 2 and stirrup strap 5 may be a single strip of leather having a looped end 7 which suspends a usual stirrup 8 therefrom with an upper looped end (not shown) extending about an attachment buckle or other component of the saddle for suspending the strap therefrom. In the alternative, saddle strap 2 could be a strap completely separate from stirrup strap 5.

Figure 2:
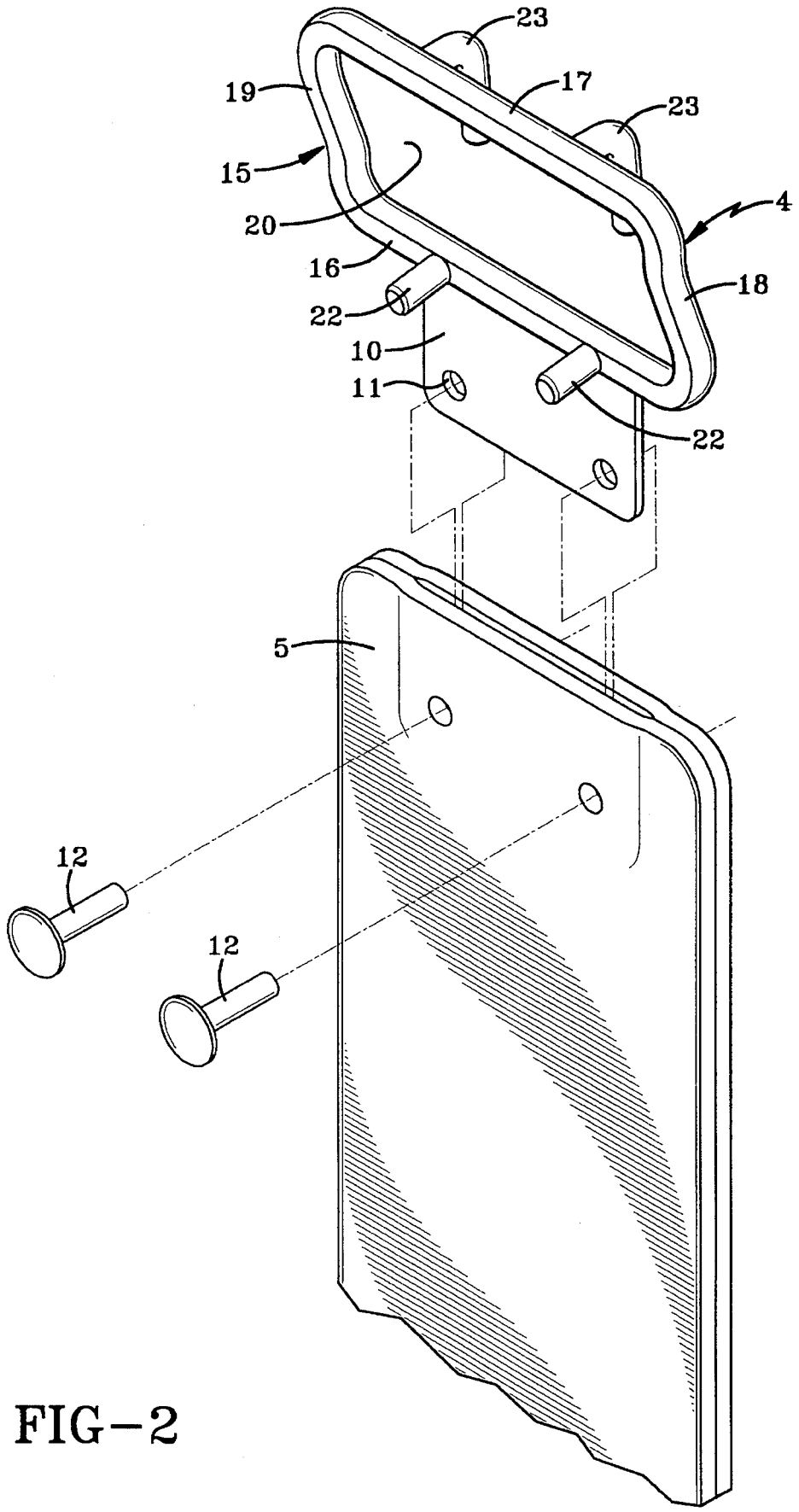
FIG. 2 is an exploded view of the buckle and an end of the stirrup strap.
Figure 3:
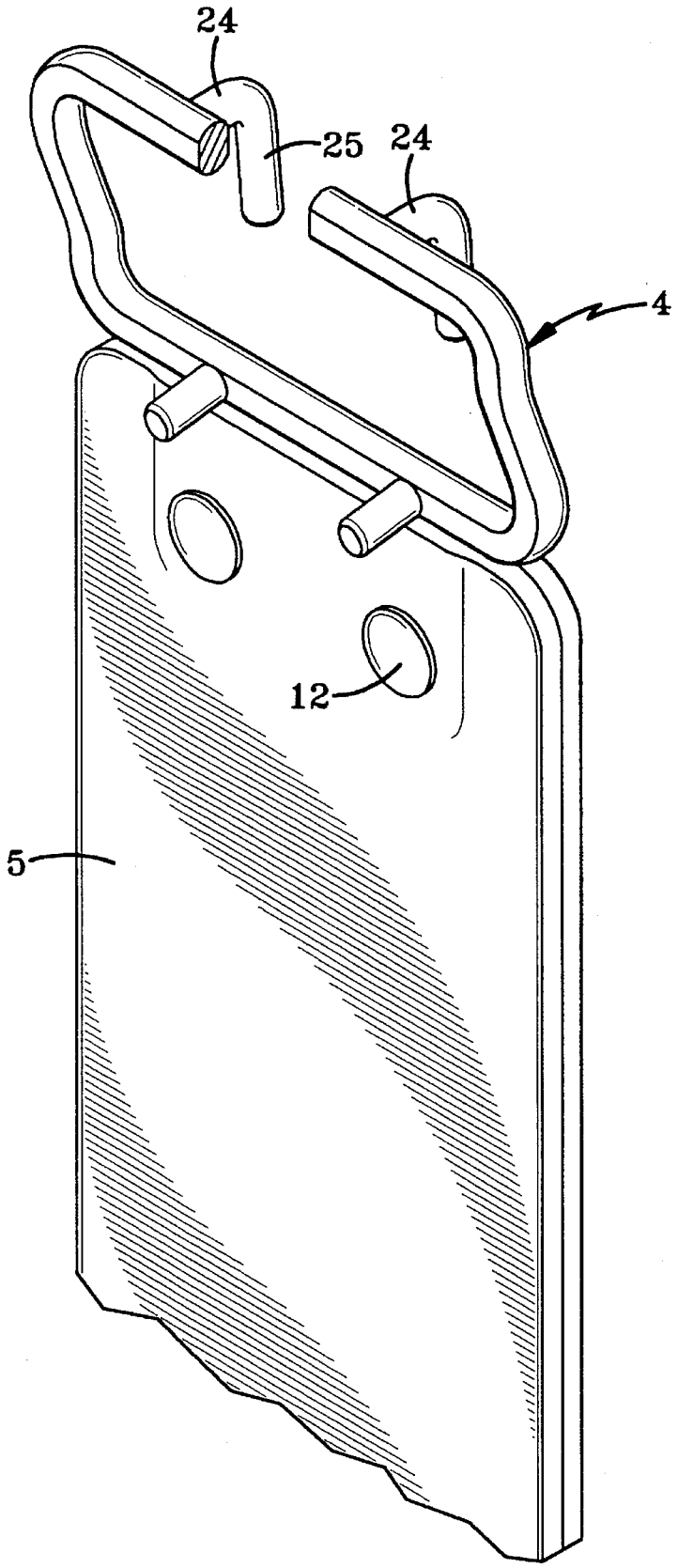
FIG. 3 is a perspective view similar to FIG. 2, showing the stirrup buckle with portions broken away, secured in the end of the stirrup strap.

Buckle 4 is shown in detail in FIGS. 2 and 3, and preferably is an integral one-piece member formed of stainless steel. Buckle 1 includes a generally flat mounting plate 10 which is formed with a plurality of holes 11, for securely and permanently attaching it in an end of stirrup strap 5 by a plurality of rivets 12 or other types of fastening means. Buckle 4 also includes a generally rectangular-shaped frame indicated generally at 15, having a pair of generally straight, spaced parallel frame members 16 and more particularly, a first outer frame member 17 and a second inner frame member 16, which are joined together by side frame members 18 and 19 to form an opening 20. Side frame members 18 and 19 extend generally parallel to each other and preferably have a curved, somewhat elongated S-shaped configuration, as shown in FIG. 5, the purpose of which is discussed further below.

Figure 5:
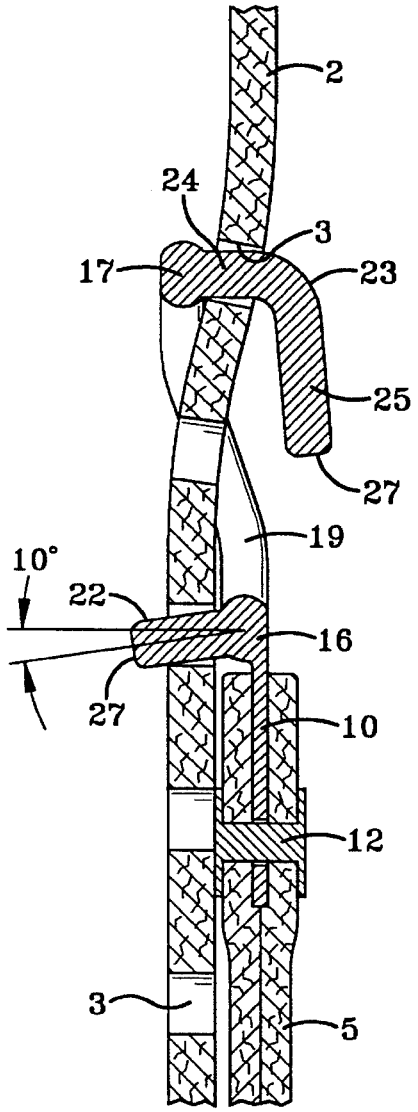
FIG. 5 is a fragmentary sectional view taken on line 5—5, FIG. 4.

A pair of posts 22 are formed integrally on frame member 16 and extend outwardly therefrom and have a very slight downwardly extending angle such as shown in FIG. 5, for example 10 degrees. A second pair of posts 23 are formed on opposite frame member 17 and have a first portion 24 which extends generally perpendicularly outwardly with respect to frame member 17, and a second portion 25 which extends generally at a right angle from first portion 25 toward opposed posts 22.

Posts 22 and 23 are generally cylindrically shaped and have generally flat free ends 27, with the ends of posts 23 being located generally opposite the center of opening 20.

Figure 4:
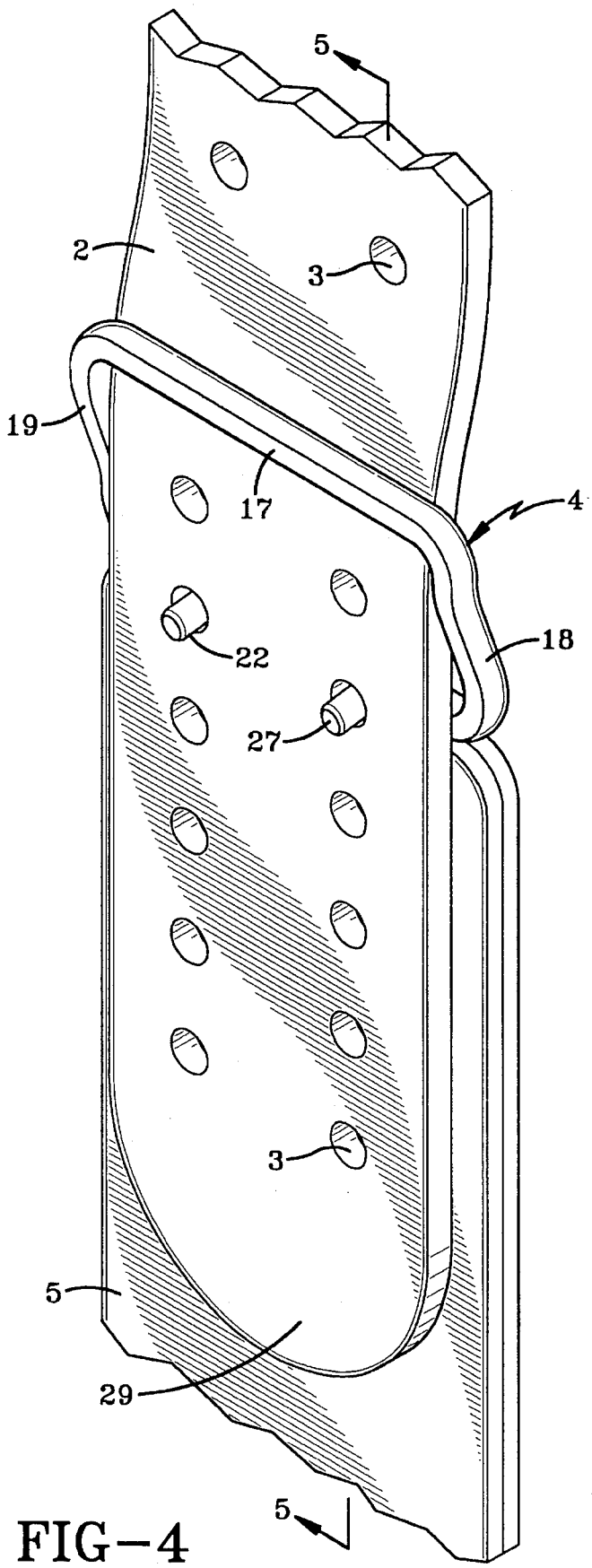
FIG. 4 is a perspective view showing the saddle strap being connected to the stirrup strap by the buckle of the present invention.

The manner in which buckle 4 is utilized for connecting saddle strap 2 to stirrup strap 5 is illustrated in FIGS. 4 and 5. The free end 29 of saddle strap 2 is inserted through buckle opening 20 and bent hook posts 23 are initially inserted through a selective pair of holes 3 with the strap surface abutting frame member 17, with post portions 24 extending through the selected holes 3, afterwhich angled posts 22 are inserted through another pair of holes 3 to secure the two straps together in an adjusted position. As shown in FIGS. 4 and 5, the spacing between frame members 16 and 17 and correspondingly between posts 22 and first portions 24 of posts 23, is generally equal to twice the spacing between the pairs of holes 3 formed in strap 2.

As shown in FIG. 5, the elongated angular configuration of side frame members 18 and 19 enable straps 2 and 5 to lie in separate generally parallel planes, which are relatively close to each other to eliminate a sharp bend and undesirable projection from occurring in strap 2, which could occur if the side frame members were not so angled.

It can be seen in FIG. 5 that the normal jarring, twisting and various forces exerted on strap 5 by the rider's foot in the stirrup, as well as such forces that are exerted on strap 2, cannot dislodge or separate the connection between the straps provided by buckle 4. In order to disengage the joined straps, it requires that strap 5 be moved generally downwardly and then outwardly to disengage posts 22 from strap holes 3, followed by a nearly complete opposite movement thereof in order to initially disengage first portions 24 of posts 23 followed by a subsequent 90 degree change of direction in order to disengage second portions 25 of posts 23 from within the selected holes 3.

Flat ends 27 of the posts eliminate sharp projections which could injure or irritate either the horse or the rider. Bent end portions 25 of posts 23 are prevented from contacting the horse by saddle fenders 30 which are provided on most Western type saddles, and if used on English or Australian type saddles, may have a protective leather sleeve which is slid over the buckle after the connection has been made. Furthermore, posts 22 have a length generally equal to or slightly greater than the thickness of strap 2 so that the exposed free ends 27 extend only a very small distance beyond the outer surface of saddle strap 2 so they will not irritate or injure the leg of the rider.

Figure 6:
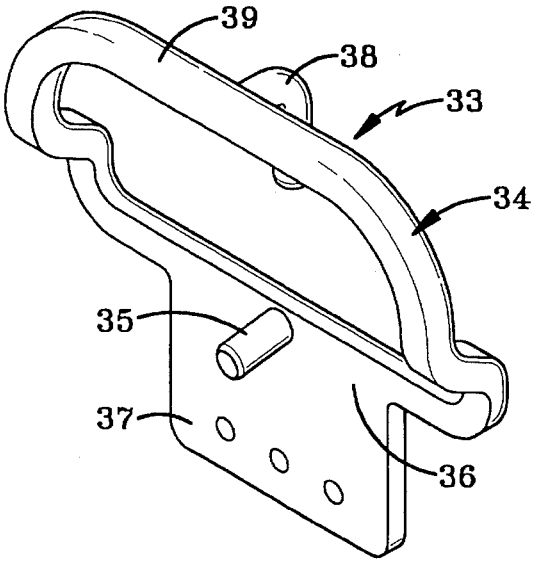
FIG. 6 is a perspective view of a modified form of the stirrup buckle removed from the stirrup strap.
Figure 7:
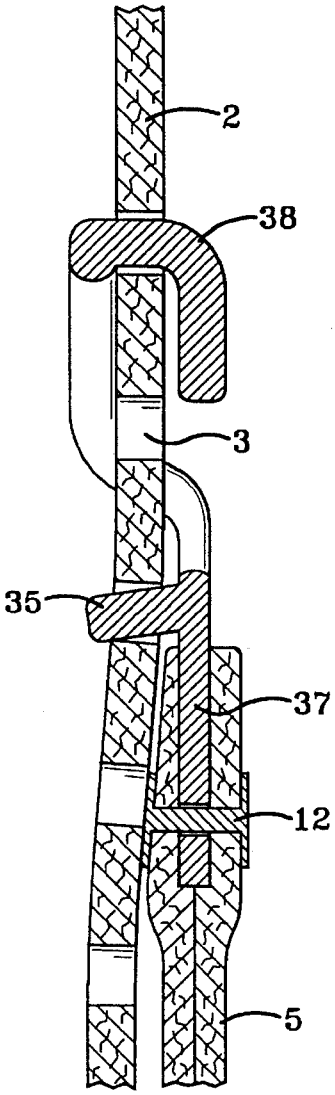
FIG. 7 is a fragmentary sectional view similar to FIG. 5, showing the modified buckle of FIG. 6 releasably securing the stirrup strap to the saddle strap.

A slightly modified buckle construction is indicated generally at 33 and is shown in FIGS. 6 and 7. Buckle 33 is generally similar to buckle 4 discussed above, except its frame 34 has a generally elongated somewhat oval-shaped configuration and has a single post 35 formed on the upper portion 36 of the mounting plate 37. Post 35 is similarly angled with respect to mounting plate 37 as are posts 22 discussed above. A single bent post 38 is mounted opposite of post 35 and extends outwardly and downwardly from top portion 39 of frame 34. The side members of frame 34 are also angled as are side frame members 18 and 19 of frame 15 as shown in FIG. 7, so as to eliminate a sharp bend in saddle strap 2.

Buckle 33 secures saddle strap 2 to stirrup strap 5 as shown in FIG. 7, in a similar manner as does buckle 4 as shown in FIG. 5, and therefore is not described in further detail.

Accordingly, as discussed above and shown in the drawings, buckles 4 and 33 provide a device for quickly and easily adjusting the length of the stirrups, while ensuring that the connected straps will not become disengaged during unusual movement of the saddle and/or stirrups, and that repeated connecting and disconnecting of the buckles will not cause the buckle to lose its effectiveness.

It is also seen in FIGS. 5 and 7 that a downward force exerted on stirrup strap 5 will cause the buckle to pivot in a clockwise direction forcing top posts 23 and 38 into tighter engagement within their respective saddle strap holes. The downward angle on posts 22 and 35 also assists the posts to be retained in their respective mounting holes due to the somewhat wedging action between the posts and straps, further preventing their accidental removal from the strap. Even if posts 22 and 35 become disengaged from their respective mounting holes, the strap buckle still will be securely fastened due to the firm connection provided by bent posts 23 and 38 with the strap.

Accordingly, the improved stirrup buckle is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and prin-ciples of the invention, the manner in which the improved stirrup buckle is constructed and used, the characteristics of the construction, and the advantageous, new and useful results obtained; the new and useful structures, devices, elements, arrangements, parts and combinations, are set forth in the appended claims.

I claim:

1. A stirrup buckle for releasably connecting a stirrup strap with a saddle strap, said stirrup buckle comprising an integral one-piece member including:

a frame defining the periphery of an opening, said frame having a pair of generally straight, spaced apart parallel frame members defining a first outer frame member and a second inner frame member joined together by a pair of elongated curved side frame members;

attachment means for securely attaching said buckle to an end of either said stirrup or said saddle strap, the other of said straps being formed with a series of spaced holes therein, said attachment means comprising a generally flat mounting plate extending from said second inner frame member opposite said first outer frame member, said mounting plate including complementary spaced holes therethrough;

first hook post means formed integrally with said first outer frame member and extending normal to the plane of said frame having the distal ends being bent inwardly toward the center of said opening for cooperative engagement with a hole of said strap; and second post means formed integrally with said second inner frame member, said second post means extending outwardly generally perpendicular to said flat mounting plate for insertion through at least one selected hole of said other strap.

2. The buckle defined in claim 1 in which the frame is generally rectangular having first, second, third and fourth integrally formed frame members.

3. The buckle defined in claim 2 in which the first and second post means each includes a pair of spaced posts formed integrally on the first and second frame members respectively.

4. The buckle defined in claim 3 in which the buckle frame is an elongated rectangle with the first and second frame members being longer than the third and fourth frame members.

5. The buckle defined in claim 3 in which each of the posts has a circular cross section.

6. The buckle defined in claim 3 in which each of the second pair of posts has a first portion which extends generally perpendicularly outwardly from the second frame member, and a second portion which extends generally perpendicularly from the first portion toward the buckle opening.

7. The buckle defined in claim 3 in which the attachment means includes a generally flat mounting plate formed integrally with and extending outwardly from the first frame member.

8. The buckle defined in claim 7 in which each of the first pair of posts has a generally straight configuration and extend outwardly from the first frame member at a slight angle with respect to the mounting plate.

9. The buckle defined in claim 7 in which each of the second pair of posts has a bent configuration with free ends of the posts extending toward the first frame member.

10. The buckle defined in claim 9 in which the free ends of the second posts terminate generally adjacent the center of the frame opening.

11. The buckle defined in claim 3 in which the third and fourth frame member have a curved configuration, whereby the first and second frame members are offset with respect to each other.

12. The buckle defined in claim 1 in which the attachment means is a generally flat plate secured to an end of the stirrup strap by rivets.

13. The buckle defined in claim 1 in which the buckle is an integral one-piece member formed of stainless steel.

14. The buckle defined in claim 1 in which the buckle frame has a generally elongated oval-like configuration; and in which the first and second post means is a first and second post respectively, located centrally in opposed portions of said buckle frame.

15. The buckle defined in claim 14 in which the attachment means is a plate; and in which the first post is located adjacent the mounting plate and extends outwardly therefrom slightly less than perpendicular with respect to said plate.

16. The buckle defined in claim 1 in which the first post means has a length equal to or slightly greater than the thickness of the saddle strap.

* * * * *